United States Patent [19]

Murayama

[11] 4,165,009

[45] Aug. 21, 1979

[54] BOTTLE CLOSURE FOR SALES PROMOTION

[75] Inventor: Kashiwa Murayama, Fujisawa, Japan

[73] Assignee: Japan Crown Cork Co., Ltd., Tokyo, Japan

[21] Appl. No.: 868,874

[22] Filed: Jan. 12, 1978

[51] Int. Cl.[2] ..... B65D 55/00

[52] U.S. Cl. ..... 215/230; 215/228; 215/254; 215/341

[58] Field of Search ..... 215/227, 228, 230, 253, 215/254, 256, 328, 341, 365; 113/121

[56] References Cited

U.S. PATENT DOCUMENTS

| | | | |
|---|---|---|---|
| 3,233,770 | 2/1966 | Waters | 215/230 |
| 3,257,021 | 6/1966 | Brockett | 215/328 |
| 3,332,565 | 7/1967 | Elser | 215/256 |
| 3,581,690 | 6/1971 | Zapata | 113/121 A |
| 4,030,630 | 6/1977 | Yealy | 215/256 |

*Primary Examiner*—Ro E. Hart

*Attorney, Agent, or Firm*—Wenderoth, Lind & Ponack

[57] ABSTRACT

A closure for sales promotion comprising a closure shell having the indication of a prize offer on its inner bottom surface and a gasket bonded to its inner bottom surface, the gasket having a center panel portion held half-adhered or non-adhered to the inner bottom surface of the closure shell and a peripheral sealing portion firmly adhered to the inner bottom surface of the closure shell, the center panel portion being completely defined from the peripheral sealing portion by a breakable line so that the center panel portion can be stripped off from the inner bottom surface of the closure shell while leaving the peripheral sealing portion.

10 Claims, 9 Drawing Figures

Fig. 7A
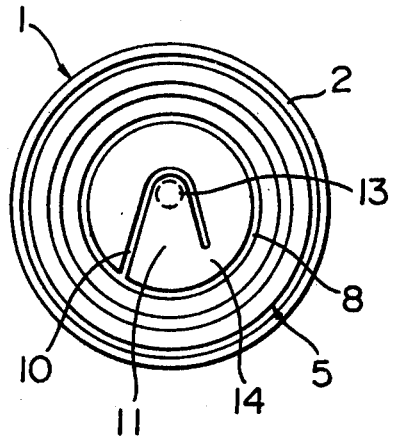
Fig. 7B
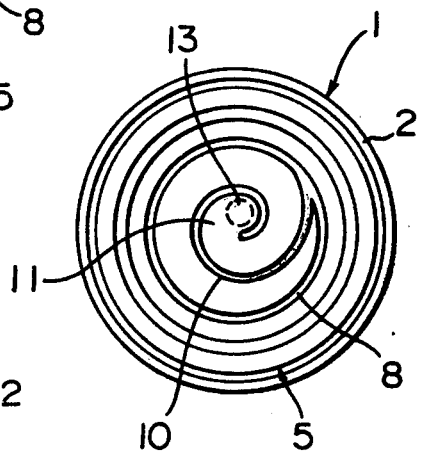
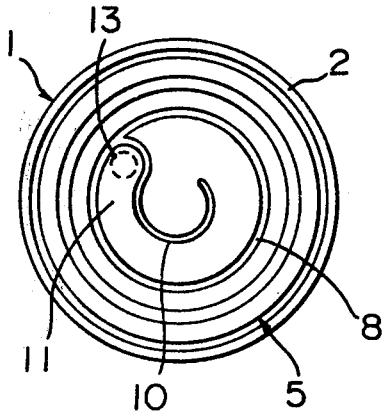
Fig. 7C

BOTTLE CLOSURE FOR SALES PROMOTION

BACKGROUND OF THE INVENTION

This invention relates to a new bottle closure adapted to be used for sales promotion, and more specifically, to a re-sealable bottle closure for sales promotion.

Crown caps have heretofore been widely used as bottle closures for sales promotion. These crown caps permit the removal of the entire gasket, but this mechanism cannot be applied to closures which require re-sealing, such as screw closures. With the development of various re-sealable bottle closures in recent years, there has been an increasing tendency toward selling beverages in large-capacity containers. The manufacturers and distributors of such bottled beverages have shown a stronger desire for incorporating the indication of prize offer into the closures of such large-capacity containers with a view to promoting sales.

SUMMARY OF THE INVENTION

It is an object of this invention to provide a re-sealable bottle closure for sales promotion.

Another object of this invention is to provide a re-sealable bottle closure for sales promotion in which the center panel part of the gasket alone can be very easily peeled off while leaving the sealing portion of the gasket.

Other objects and advantages of the invention will apparent from the following description.

According to this invention, there is provided a bottle closure for sales promotion comprising a closure shell having the indication of a prize offer on its inner bottom surface and a gasket bonded to its inner bottom surface, the gasket having a center panel portion held half-adhered or non-adhered to the inner bottom surface of the closure shell and a peripheral sealing portion firmly adhered to the inner bottom surface of the closure shell, the center panel portion being completely defined from the peripheral sealing portion by a breakable line so that the center panel portion can be stripped off from the inner bottom surface of the closure shell while leaving the peripheral sealing portion.

BRIEF DESCRIPTION OF THE DRAWINGS

The closure of the present invention is described hereinbelow with reference to the accompanying drawings in which:

FIGS. 7(A), 7(B) and 7(C) are top plans showing various shapes, of the tear strip portion of the closure of this invention with the inside of each closure facing upwardly.

DETAILED DESCRIPTION OF THE INVENTION

Figure 1:
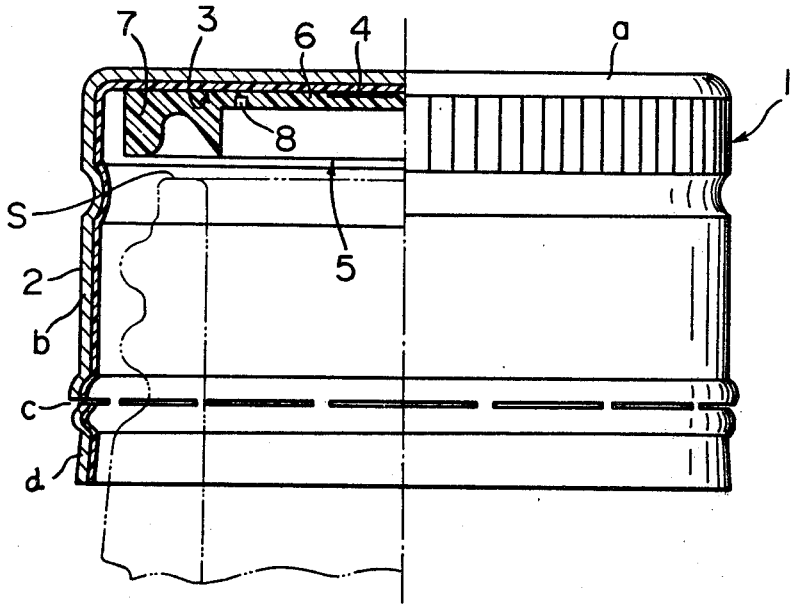
FIG. 1 is a partly cut-away side elevation of one embodiment of the closure of this invention.

In FIG. 1 which shows the entire arrangement of the bottle closure provided by the present invention, closure 1 consists basically of a shell 2 having the indication 4 of a prize offer on its inner bottom surface 3, and a gasket 5 bounded to the inner bottom surface 3. As a typical example, FIG. 1 shows a "roll-on" pilfer proof cap shell 2 having a circular panel a and in a skirt portion extending downwardly from the peripheral edge of panel a thread-forming portion b, a slit portion c and a pilfer proof band d. The present invention, however, is also applicable to other types of bottle closures such as a roll-on cap shell, a pre-screw cap shell or a lug cap shell.

The material of the gasket applied to such a closure shell is not critical, and various synthetic resins ordinarily used in the art are also feasible in this invention. Typical examples are polyolefins such as polyethylene or polypropylene, rubbers such as a styrene-butadiene rubber, and polyvinyl chloride. Polyethylene is an especially suitable material for the gasket for use in the present invention.

The indication of a prize offer on the inner bottom surface 3 of the closure shell can be provided by printing as in the case of conventional crown caps for sales promotion. It is adapted to be transferred to the gasket to the peeled off, as required. Such a transferable indication of a prize offer is known, and disclosed, for example, in U.S. Pat. Nos. 3,257,021, 3,361,281, 3,581,690, and 3,633,781.

The first characteristic feature of the closure of this invention is that the center panel portion 6 of the gasket 5 is selectively held partially or half-adhered or non-adhered to the inner bottom surface 3 of the closure shell 2 or, and the peripheral sealing portion 7 of the gasket 5 is firmly bonded to the inner bottom surface 3 of the closure shell.

Throughout the present specification and the appended claims, the term "center panel portion" of the gasket denotes the thin central portion of the gasket which does not make contact with the sealing end (the portion indicated by the letter "S" in FIG. 1) of a container to be closed. The term "peripheral sealing portion" of the gasket, denotes the thick peripheral edge portion of the gasket which comes into close engagement with the sealing end of a container to be closed to form a gas- and liquid-tight seal.

Any known method can be used to hold the center panel portion of the gasket half-adhered or non-adhered to the inner bottom surface of the closure shell, and to cause the peripheral sealing portion of the gasket to adhere firmly to the inner bottom surface of the closure shell. For example, this can be accomplished by coating or printing a lacquer or ink, which adheres firmly to a gasket material applied, on that zone of the inner bottom surface of the closure shell with which the peripheral sealing portion of the gasket makes contact, and a lacquer or ink, which adheres weakly, or does not substantially adhere, to the gasket material applied, on that zone which makes contact with the center panel portion of the gasket. An alternative method comprises coating the entire inner bottom surface of the closure shell with a lacquer or ink which adheres firmly to the gasket material applied, and performing entire surface or half-tone dot printing on that zone of the inner bottom surface of the closure shell which makes contact with the center panel portion of the gasket using a lacquer or ink which does not substantially adhere to the gasket material, whereby the adhering condition of the center panel portion of the gasket to the halftone dot printed portion of the inner bottom surface of the closure shell can be adjusted between a half-adhering state and a substantially non-adhering state.

Furthermore, by utilizing the method disclosed in German Offenlegungsschrift No. 2711727, only the center panel portion of the gasket can be maintained half-adhered to the inner bottom surface of the closure shell. The methods disclosed in Japanese Laid-Open Patent Publications Nos. 126484/1974 and 150188/1977 can also be utilized.

When polyethylene is used as a gasket material, a lacquer or ink for firm bonding may be composed mainly of oxidized polyethylene as disclosed in British Patent Specification No. 1,484,209. Lacquers or inks for half-bonding or non-bonding include a blend of a small proportion of oxidized polyethylene with another compatible resin, or those containing an epoxy-phenol resin, an epoxy-urea resin, or an alkyd resin. When polyvinyl chloride is used as a material for the gasket, the lacquer or ink for firm bonding may be one which consists mainly of a vinyl chloride-vinyl acetate copolymer or an acrylic resin. Lacquers or inks for non-bonding are preferably those which contain an epoxy-phenol resin, an epoxy-urea resin, or an alkyd resin as a main component.

Another characteristic feature of the closure of this invention is that the center panel portion 4 of the gasket 5 is completely separated from the peripheral sealing portion 7 of the gasket 5 by a breakable line 8. As is clear from FIG. 2, the breakable line 8 can be formed in a complete annular shape in proximity to the peripheral sealing portion 7 of the gasket 5. The breakable line 8 may be a score incised on the center panel portion 6 of the gasket 5, as shown in FIG. 1 or 3. Or it may be a slit-like line which extends to the inner bottom surface 3 of the closure shell, or a perforation line. In short, any line is feasible which can permit the separation of the center panel portion 6 from the peripheral sealing portion 7 along the breakable line 8 without any great force.

Since the center panel portion 6 is held half-adhered or non-adhered to the inner bottom surface 3 of the closure shell 2 or by a half-adhering or non-adhering lacquer layer $L_1$ as shown in FIG. 3, it can be readily raised by hooking the tip of a finger nail or a pointed tool T in the breakable line 8 and pulling it upwardly. The force to raise the center panel 6 results in the breaking of the breakable line 8, and the center panel 6 can be separated from the inner bottom surface 3 of the closure shell and finally can be taken out of the closure shell leaving the peripheral sealing portion 7.

Since the indication of a prize offer 4 is provided on the inner bottom surface 3 of the closure shell which is beneath the center panel 6, it becomes visible as a result of the removal of the center panel.

Figure 4:
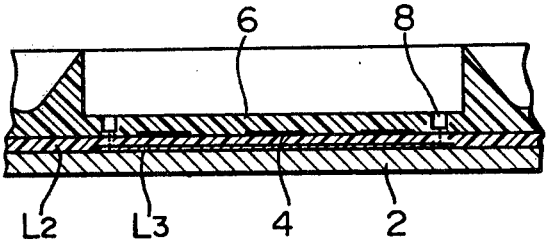
FIG. 4 is an enlarged view, partly in section, of a modification of the closure shown in FIG. 2, in which the indication of a prize offer is removable.

In an alternative embodiment shown in FIG. 4, the indication 4 of a prize offer is printed on a lacquer layer $L_2$ to which the gasket adheres firmly, and a lacquer layer $L_3$ which is substantially non-adhering to the lacquer layer $L_2$ is provided in an area between the lacquer layer $L_2$ and the inner bottom surface of the closure shell which corresponds to the center panel portion 6. According to this embodiment, the lacquer layer $L_2$ breaks at the part shown by the dotted line in the drawing by the operation of separating the center panel portion 6, and is thus lifted together with the center panel portion 6. Consequently, the indication 4 of a prize offer is transferred to the back surface of the center panel 6, and is removed from the closure shell. The center panel portion 6 having the indication 4 of prize offer so transferred can be directly used for the purpose of assigning the prize.

Figure 2:
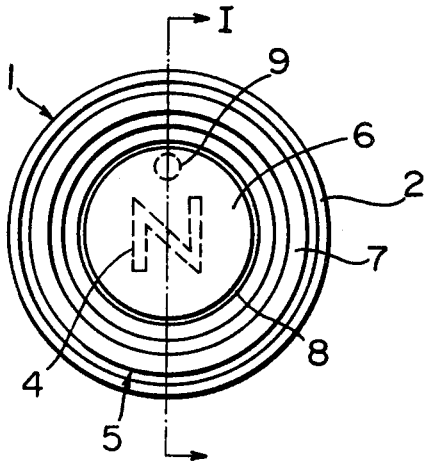
FIG. 2 is a top plan of the closure of the invention with its inside facing upwardly.
Figure 3:
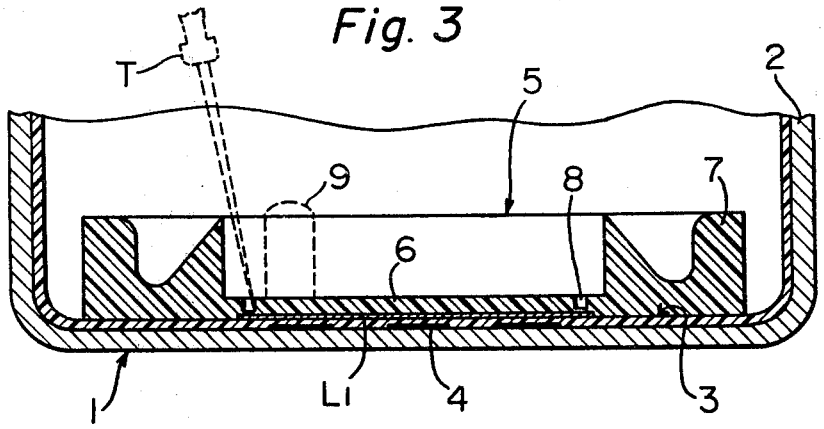
FIG. 3 is an enlarged sectional view taken along the line I—I of FIG. 2.

In order to obviate the use of a tool for separating the center panel portion 6 or to render the separation easier, a knob 9 may be provided at a part of the periphery of the center panel as shown by a dotted line in FIGS. 2 and 3. The shape and size of the knob 9 are not critical, and it may be of such a size and shape which permit holding by fingers. Advantageously, it has a height of about 2 to 5 mm, and a maximum diameter of about 2 to 5 mm, although the dimensions may vary according to the size of the closure shell. The shape of the knob 9 may, for example, be dome-like, spherical, cylindrical, or rectangular piller-shaped.

According to a preferred embodiment to be described hereinbelow with reference to FIGS. 5 and 6, a tear strip portion which can be cut and lifted by being partially defined by a breakable line may be provided in the center panel in order to facilitate the separation of the center panel.

Figure 5:
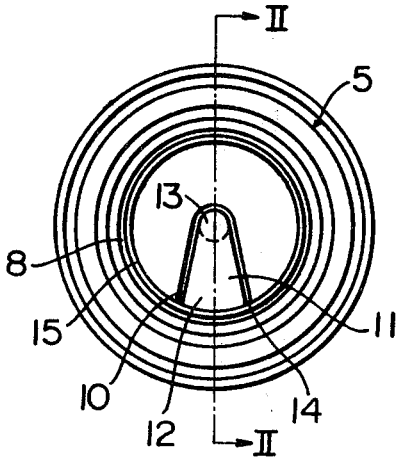
FIG. 5 is a top plan of another embodiment of the closure of the invention with its inside facing upwardly.
Figure 6:
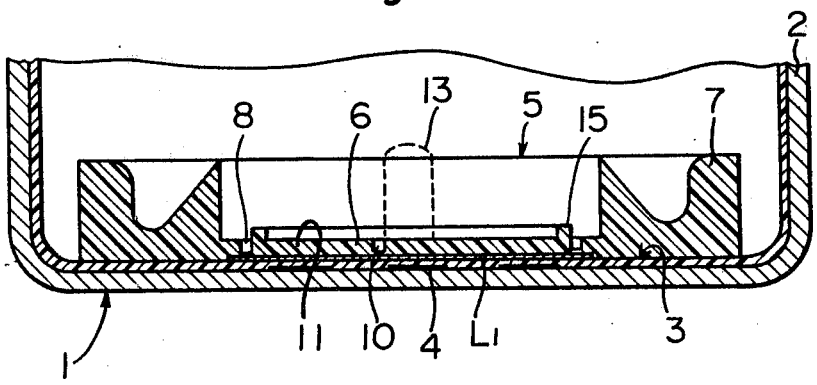
FIG. 6 is an enlarged sectional view taken along the line II—II of FIG. 5.

Referring to FIGS. 5 and 6, a tear strip portion 11 capable of being cut and lifted along a breakable line 10 is formed in the center panel portion 6 of gasket 5. The tear strip portion 11 is only partly surrounded by the breakable line 10, and is integrated with the remainder of the center panel portion 6 of the gasket at a non-continuous portion 12 of the breakable line 10. The breakable line 10 may be any of a score, slit or perforation line as described hereinabove with regard to the breakable line 8.

In operation, the tear strip portion 11 of the closure shown in FIGS. 5 and 6 is cut and lifted by a finger nail or a tool, and is further lifted by holding it with fingers. Since the tear strip portion 11 is integrated with the center panel portion 6 at the non-continuous portion 12, the entire center panel portion 6 can be separated from the closure by this operation.

Desirably, a knob 13 is provided at the tip portion of the tear strip portion 11 as shown by a dotted line in FIGS. 5 and 6 in order to facilitate the operatio of cutting and lifting the tear strip portion 11. The size and shape of the knob 13 may be the same as those described hereinabove with regard to knob 9 shown in FIGS. 2 and 3.

In the embodiment shown in FIGS. 5 and 6, a reinforcing rib 15 may be provided in order to prevent the breakage of a weak bridging portion 14 near the non-continuous portion 12 of the tear strip portion 11 during the lifting of the tear strip portion 11 and the center panel portion 6.

The tear strip portion 11 is wedge-shaped in FIG. 5, but this shape is not limitative. For example, various shapes shown in FIGS. 7(A), 7(B) and 7(C) may be employed. For example, as shown in FIG. 7(A), one end of V-shaped breakable line 10 is connected to the breakable line 8, and the other end terminates halfway in the center panel portion 6 leaving an enlarged bridging portion 14. Alternatively, as shown in FIGS. 7(B) and 7(C), one end of a convoluted or S-shaped breakable line 10 is connected to the breakable line 8, and the other end terminates at the central part of the center panel portion 6 of the gasket.

Of course, a knob 13 may be provided at the tip portion of the tear strip portion surrounded by the breakable line 10, as shown by a dotted line in each of FIGS. 7(A), 7(B) and 7(C).

The gasket of the various shapes described hereinabove is applied to the inner bottom surface of a closure shell by the ordinary molding method. Molding can be performed easily by using a molding punch which has a projection or a depression for forming a breakable line and as required, a knob or rib on its surface.

According to the closure of this invention, only the center panel portion of the gasket is separated and removed, and the peripheral sealing portion remains firmly adhered to the inner bottom surface of the closure shell. Thus, even after the center panel portion has been separated for determining the indication of a prize offer, the closure can be used for re-sealing. The closure of this invention can therefore be used widely for large-capacity containers with the indication of a prize offer for sales promotion.

When the closure of the invention is used for returnable bottles, it has the advantage of protecting the sealing end of the used bottles at the time of recovery.

What we claim is:

1. A closure for sales promotion comprising:

a closure shell having an inner bottom surface;

an indication of a prize offer positioned adjacent said inner bottom surface; and a sealing gasket including a peripheral sealing portion firmly adhered to said inner bottom surface and a central panel portion removably positioned on said inner bottom surface and separated from said peripheral sealing portion by a breakable line, such that said central panel portion can be stripped from said inner bottom surface while leaving said peripheral sealing portion firmly adhered thereto.

2. A closure as claimed in claim 1, wherein said central panel portion is partially adhered to said inner bottom surface.

3. A closure as claimed in claim 1, wherein said central panel portion is not adhered to said inner bottom surface.

4. A closure as claimed in claim 1, wherein said central panel portion has adjacent a peripheral edge thereof a knob.

5. A closure as claimed in claim 1, wherein said indication of a prize offer is positioned on said inner bottom surface.

6. A closure as claimed in claim 1, wherein said indication of a prize offer is positioned on said central panel portion.

7. A closure as claimed in claim 1, wherein said central panel portion includes a tear strip portion which is partially defined by a breakable line and which can be lifted to aid in stripping said central panel portion.

8. A closure as claimed in claim 7, wherein said tear strip portion has a knob adjacent an end thereof.

9. A closure as claimed in claim 7, wherein said tear strip portion is substantially wedge-shaped.

10. A closure as claimed in claim 7, wherein said tear strip portion is curved.

* * * * *